US011791144B2

(12) United States Patent
Kalafut et al.

(10) Patent No.: US 11,791,144 B2
(45) Date of Patent: Oct. 17, 2023

(54) OPTIMIZING MASS SPECTRA SIGNAL QUALITY

(71) Applicant: Thermo Finnigan LLC, San Jose, CA (US)

(72) Inventors: Bennett S. Kalafut, San Jose, CA (US); Joshua A. Silveira, Gilroy, CA (US); Abhishek Joshi, Urbana, IL (US); Eloy R. Wouters, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 213 days.

(21) Appl. No.: 17/197,986

(22) Filed: Mar. 10, 2021

(65) Prior Publication Data

US 2022/0293405 A1 Sep. 15, 2022

(51) Int. Cl.
*H01J 49/00* (2006.01)
*H01J 49/42* (2006.01)

(52) U.S. Cl.
CPC ..... *H01J 49/0036* (2013.01); *H01J 49/426* (2013.01)

(58) Field of Classification Search
CPC .. H01J 49/0036; H01J 49/426; H01J 49/0009; H01J 49/0404; H01J 49/165
USPC ..... 250/281, 282, 288
See application file for complete search history.

(56) References Cited

U.S. PATENT DOCUMENTS

| | | | | |
|---|---|---|---|---|
| 6,977,372 | B2 * | 12/2005 | Valaskovic | H01J 49/165 250/281 |
| 9,799,481 | B2 | 10/2017 | Hieke | |
| 11,031,231 | B2 | 6/2021 | Derek et al. | |
| 2005/0072915 | A1 * | 4/2005 | Stults | H01J 49/0018 250/288 |
| 2021/0159061 | A1 * | 5/2021 | Silveira | H01J 49/0031 |

OTHER PUBLICATIONS

Valaskovic et al., "Automated Orthogonal Control System for Electrospray Ionization," Journal of the American Society for Mass Spectrometry, 2004, No. 15, pp. 1201-1215.
Kertesz et al., "Automation of a Surface Sampling Probe/Electrospray Mass Spectrometry System," Analytical Chemistry, 2005, vol. 77, No. 22, pp. 7183-7189.
Zhang et al., "Quantitative Determination of Noncovalent Binding Interactions Using Automated Nanoelectrospray Mass Spectrometry," Analytical Chemistry, 2003, vol. 77, No. 13, pp. 3010-3018.

* cited by examiner

*Primary Examiner* — Michael Maskell

(57) ABSTRACT

An optimization control system may receive mass spectra of ions emitted from an ionization emitter toward an inlet of a mass spectrometer and control, based on the mass spectra, an automated motion system to adjust a position of the emitter relative to the inlet.

33 Claims, 11 Drawing Sheets

OPTIMIZING MASS SPECTRA SIGNAL QUALITY

BACKGROUND INFORMATION

A mass spectrometer is a sensitive instrument that may be used to detect, identify, and/or quantify molecules based on their mass-to-charge ratio (m/z). A mass spectrometer generally includes an ion source for generating ions from components included in the sample, a mass analyzer for separating the ions based on their m/z, and an ion detector for detecting the separated ions. The mass spectrometer may be connected to a computer-based software platform that uses data from the ion detector to construct a mass spectrum that shows a relative abundance of each of the detected ions as a function of m/z. The m/z of ions may be used to detect and quantify molecules in simple and complex mixtures.

An ion source may generate ions from an analyte in many different ways. In conventional electrospray ionization (ESI), a liquid sample flows through a small-diameter capillary emitter positioned in front of a mass analyzer inlet. A high voltage is applied to the liquid sample in the emitter to generate an electrospray that results in the formation of analyte ions. Analyte ions that enter the mass analyzer inlet are then analyzed by mass spectrometry to generate mass spectra of the analyte ions. In conventional ESI, the liquid sample has a flow rate ranging from about 1 microliter (μL) per minute (1 μL/min) to about 1 milliliter (mL) per minute (1 mL/min). In nanospray ionization (NSI), the liquid sample flows through the emitter under nanoscale flow rates ranging from about 10-50 nanoliters (nL) per minute (10-50 nL/min) to about 1000-1500 nL/min. The lower flow rates of NSI produce smaller aerosol droplets, which makes NSI more effective than conventional ESI at concentrating the analyte at the emitter tip. As a result, NSI produces significant increases in sensitivity as demonstrated by the signal response of the mass spectrometer.

However, the efficiency and stability of all ESI methods varies with the position of the emitter relative to the mass analyzer inlet among other factors, such as solvent conditions, mobile phase composition, flow rate, analyte chemistry, electrospray voltage, sheath (or nebulization) gas flow rate, ambient pressure, temperature, and inlet geometry. This is particularly true for NSI, in which the spatially optimum position of the emitter is a fraction of a millimeter wide in all directions. For example, deviations of the emitter position from an optimal position by only 100 microns (μm) may result in a 20% decrease in signal intensity.

SUMMARY

The following description presents a simplified summary of one or more aspects of the methods and systems described herein in order to provide a basic understanding of such aspects. This summary is not an extensive overview of all contemplated aspects and is intended to neither identify key or critical elements of all aspects nor delineate the scope of any or all aspects. Its sole purpose is to present some concepts of one or more aspects of the methods and systems described herein in a simplified form as a prelude to the more detailed description that is presented below.

In some illustrative embodiments, a system comprises one or more processors and memory storing executable instructions that, when executed by the one or more processors, cause a computing device to receive mass spectra of ions emitted from an ionization emitter toward an inlet of a mass spectrometer; and control, based on the mass spectra, an automated motion system to adjust a position of the emitter relative to the inlet.

In some illustrative embodiments, the controlling the automated motion system to adjust the position of the emitter relative to the inlet comprises performing an iterative optimization process.

In some illustrative embodiments, the iterative optimization process is configured to optimize intensity, signal-to-noise ratio, or stability of mass spectra subsequently acquired by the mass spectrometer.

In some illustrative embodiments, the iterative optimization process is configured to optimize a cost function that balances signal quality of the mass spectra and robustness of the mass spectrometer.

In some illustrative embodiments, the iterative optimization process is performed using a stochastic optimization algorithm.

In some illustrative embodiments, the iterative optimization process comprises a plurality of iterations each comprising: controlling the automated motion system to sequentially position the emitter at a plurality of distinct locations near a current position of the emitter; directing the mass spectrometer to acquire a mass spectrum while the emitter is positioned at each location included in the plurality of distinct locations; determining, based on the mass spectra acquired while the emitter is positioned at each location included in the plurality locations, an updated position for the emitter; and controlling the automated motion system to move the emitter from the current position to the updated position.

In some illustrative embodiments, the instructions, when executed, further cause the computing device to: determine, based on the mass spectra acquired while the emitter is positioned at each location included in the plurality locations, that a probability of a backward iterative step and a probability of a forward iterative step are within a tolerance range of each other; and terminate the iterative optimization process in response to the determining that the probability of a backward iterative step and the probability of a forward iterative step are within the tolerance range of each other.

In some illustrative embodiments, the instructions, when executed, further cause the computing device to determine that the mass spectra acquired during a current iteration are not better than the mass spectra acquired during a prior iteration; and terminate the iterative optimization process in response to the determining that the mass spectra acquired during the current iteration are not better than the mass spectra acquired during the prior iteration.

In some illustrative embodiments, the iterative optimization process further comprises determining that the mass spectra acquired during a current iteration fail to satisfy a criterion; and controlling, based on the determining that the mass spectra acquired during the current iteration fail to satisfy the criterion, the automated motion system to move the emitter from the current position toward a prior known good position.

In some illustrative embodiments, the moving the emitter from the current position toward the prior known good position is performed incrementally through a plurality of intermediate positions.

In some illustrative embodiments, the iterative optimization process further comprises adjusting, based on the determining that the mass spectra acquired during the current iteration fail to satisfy the criterion, at least one hyperparameter of the iterative optimization process.

In some illustrative embodiments, the at least one hyperparameter comprises at least one of a step size, a search area size, or a search scale.

In some illustrative embodiments, the automated motion system comprises one or more linear translation stages.

In some illustrative embodiments, the controlling the automated motion system to adjust the position of the emitter relative to the inlet is further based on one or more of a flow rate of a sheath gas flowing around the emitter, a flow rate of a mobile phase flowing to the emitter, a composition of a solvent in the mobile phase, or a spray voltage applied to the emitter.

In some illustrative embodiments, the instructions, when executed, further cause the computing device to adjust, based on the mass spectra, one or more of a flow rate of a sheath gas flowing around the emitter, a flow rate of a mobile phase flowing to the emitter, a composition of a solvent in the mobile phase, or a spray voltage applied to the emitter.

In some illustrative embodiments, the emitter is coupled with a separation system configured to separate, over time, components included in a sample; and the controlling the automated motion system to adjust the position of the emitter relative to the inlet is further based on a gradient of an effluent from the separation system.

In some illustrative embodiments, the controlling the automated motion system to adjust the position of the emitter relative to the inlet comprises scheduling adjustment of the emitter to a plurality of different positions at different times in the gradient.

In some illustrative embodiments, the controlling the automated motion system to adjust the position of the emitter relative to the inlet comprises determining an optimum position of the emitter relative to the inlet; and the instructions, when executed, further cause the computing device to: obtain default home position data representative of a default home position of the emitter relative to the inlet; determine that the optimum position of the emitter is out of tolerance with the default home position of the emitter; and perform, in response to the determination that the optimum position of the emitter is out of tolerance with the default home position of the emitter, a mitigation operation.

In some illustrative embodiments, the emitter comprises a nanospray ionization emitter.

In some illustrative embodiments, a method comprises: receiving, by a computing device from a mass spectrometer, mass spectra of ions emitted from an ionization emitter toward an inlet of the mass spectrometer; and controlling, by the computing device and based on the mass spectra, an automated motion system to adjust a position of the emitter relative to the inlet.

In some illustrative embodiments, an emitter cartridge comprises an emitter; a mount configured to hold the emitter and mount the emitter cartridge to an automated motion system of an ion source; and a memory storing default optimization data comprising default home position data representative of a default home position of the emitter relative to an inlet of a mass spectrometer.

In some illustrative embodiments, the default optimization data further includes data representative of at least one of a default spray voltage to be applied to the emitter, a default flow rate of a sheath gas to flow around the emitter, a default flow rate of a mobile phase to flow to the emitter, or a default composition of a solvent in the mobile phase.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Systems and methods for optimizing mass spectra signal quality are described herein. In some illustrative embodiments, a system may receive mass spectra of ions emitted from an emitter toward an inlet of a mass spectrometer. The system may control, based on the mass spectra, an automated motion system to adjust a position of the emitter relative to the inlet. In some illustrative embodiments, the system may control the automated motion system to adjust the position of the emitter relative to the inlet by performing an iterative optimization process, such as by using a stochastic optimization algorithm.

For example, in an illustrative iterative optimization process, the system may control the automated motion system to temporarily position the emitter at a plurality of locations near a current position of the emitter. The system may direct the mass spectrometer to acquire a mass spectrum while the emitter is positioned at each location included in the plurality of locations. Each mass spectrum is included in the mass spectra received from the mass spectrometer. Based on the acquired mass spectra acquired while the emitter is positioned at each location included in the plurality locations, the system may determine an updated position for the emitter. The system may then control the automated motion system to move the emitter from the current position to the updated position. This iterative step may be repeated until the system determines that the emitter is positioned at an optimum position.

The systems and methods described herein may provide various benefits, which may include one or more advantages over conventional systems and ion sources. For example, in some conventional systems the position of the emitter is fixed at a single position and cannot be adjusted, while other conventional systems require manual emitter adjustments, such as with a micrometer. As a result, the conventional systems have suboptimal sensitivity and poor reproducibility of method performance from emitter to emitter, installation to installation, and user to user. In contrast, the systems and methods described herein fully automate the emitter positioning process. Additionally, the systems and methods described herein are configured to adjust the position of the emitter to optimize one or more characteristics of the detected signal, such as signal intensity, signal-to-noise ratio, and signal stability. As a result, the systems and methods described herein improve sensitivity with reproducible results, even across different emitters, installations, and users. Moreover, the systems and methods described herein can be performed faster as compared with manual adjustments of the conventional systems.

Various embodiments will now be described in more detail with reference to the figures. The systems and methods described herein may provide one or more of the benefits mentioned above and/or various additional and/or alternative benefits that will be made apparent herein.

Figure 1:
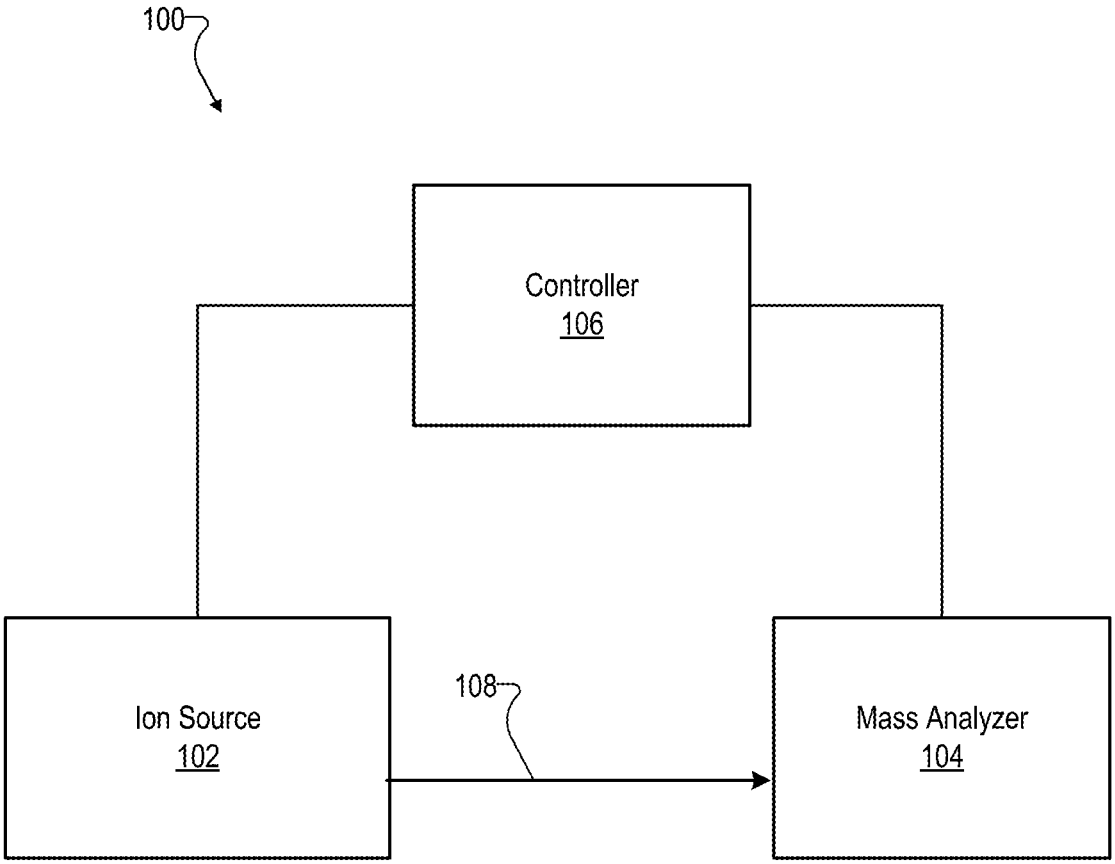
FIG. 1 shows functional components of an illustrative mass spectrometer.

The systems and methods described herein may be implemented in conjunction with a mass spectrometer. FIG. 1 shows functional components of an illustrative mass spectrometer 100. As shown, mass spectrometer 100 includes an ion source 102, a mass analyzer 104, and a controller 106. Mass spectrometer 100 may further include any additional or alternative components (not shown) as may suit a particular implementation (e.g., ion optics, filters, an autosampler, etc.).

Ion source 102 is configured to produce a stream 108 of ions from a sample by electrospray ionization (ESI) and deliver the ions to mass analyzer 104. An illustrative ion source is described below in more detail with reference to FIG. 2.

Mass analyzer 104 is configured to receive ion stream 108 and separate the ions according to m/z of each of the ions. Mass analyzer 104 may be implemented by any suitable mass analyzer, such as a quadrupole mass filter, an ion trap (e.g., a three-dimensional quadrupole ion trap, a cylindrical ion trap, a linear quadrupole ion trap, a toroidal ion trap, etc.), a time-of-flight (TOF) mass analyzer, an electrostatic trap mass analyzer (e.g. an orbital electrostatic trap such as an Orbitrap mass analyzer, a Kingdon trap, etc.), a Fourier transform ion cyclotron resonance (FT-ICR) mass analyzer, a sector mass analyzer, and the like.

An ion detector (not shown) is configured to detect ions at each of a variety of different m/z and responsively generate an electrical signal representative of ion intensity. The electrical signal is transmitted to controller 106 for processing, such as to construct a mass spectrum of the sample. For example, mass analyzer 104 may emit an emission beam of separated ions to the ion detector, which is configured to detect the ions in the emission beam and generate or provide data that can be used by controller 106 to construct a mass spectrum of the sample. The ion detector may be implemented by any suitable detection device, including without limitation an electron multiplier, a Faraday cup, and the like.

Controller 106 may be communicatively coupled with, and configured to control operations of, mass spectrometer 100. For example, controller 106 may be configured to control operation of various hardware components included in ion source 102 and/or mass analyzer 104. To illustrate, controller 106 may be configured to control a high voltage applied to an emitter in ion source 102, control an accumulation time of mass analyzer 104, control an oscillatory voltage power supply and/or a DC power supply to supply an RF voltage and/or a DC voltage to mass analyzer 104, adjust values of the RF voltage and DC voltage to select an effective m/z (including a mass tolerance window) for analysis, and adjust the sensitivity of the ion detector (e.g., by adjusting the detector gain).

Controller 106 may also include and/or provide a user interface configured to enable interaction between a user of mass spectrometer 100 and controller 106. The user may interact with controller 106 via the user interface by tactile, visual, auditory, and/or other sensory type communication. For example, the user interface may include a display device (e.g., liquid crystal display (LCD) display screen, a touch screen, etc.) for displaying information (e.g., mass spectra, notifications, etc.) to the user. The user interface may also include an input device (e.g., a keyboard, a mouse, a touchscreen device, etc.) that allows the user to provide input to controller 106. In other examples the display device and/or input device may be separate from, but communicatively coupled to, controller 106. For instance, the display device and the input device may be included in a computer (e.g., a desktop computer, a laptop computer, etc.) communicatively connected to controller 106 by way of a wired connection (e.g., by one or more cables) and/or a wireless connection.

Controller 106 may include any suitable hardware (e.g., a processor, circuitry, etc.) and/or software as may serve a particular implementation. While FIG. 1 shows that controller 106 is included in mass spectrometer 100, controller 106 may alternatively be implemented in whole or in part separately from mass spectrometer 100, such as by a computing device communicatively coupled to mass spectrometer 100 by way of a wired connection (e.g., a cable) and/or a network (e.g., a local area network, a wireless network (e.g., Wi-Fi), a wide area network, the Internet, a cellular data network, etc.).

In some embodiments, mass spectrometer 100 may be implemented by a tandem mass spectrometer, which may be tandem-in-time or tandem-in-space. For example, a tandem-in-space mass spectrometer may include, in addition to mass analyzer 104, one or more collision cells and one or more additional mass analyzers (not shown in FIG. 1). The term "collision cell," as used herein, is intended to encompass any structure arranged to produce product ions via controlled dissociation processes and is not limited to devices employed for collisionally-activated dissociation. For example, a collision cell may be configured to fragment the ions using collision induced dissociation (CID), electron transfer dissociation (ETD), electron capture dissociation (ECD), photo induced dissociation (PID), surface induced dissociation (SID), and the like. A collision cell may be positioned upstream from a mass filter, which separates the fragmented ions based on the ratio of mass to charge of the ions. In some embodiments, mass analyzer 104 may include a combination of multiple mass filters and/or collision cells, such as a triple quadrupole mass analyzer, where a collision cell is interposed in the ion path between independently operable mass filters.

In some embodiments, mass spectrometer 100 may be coupled with a separation system in a combined system configured to separate components of a sample to be analyzed by mass spectrometer 100. In an analytical run performed by a combined system, the separation system is configured to receive a sample to be analyzed and separate certain components within the sample. In some examples, the separation system may also detect a relative abundance of the separated components, such as by generating a chromatogram representative of the components within the sample. The separation system may be implemented by any device configured to separate components included in the sample, such as a liquid chromatograph (LC) (e.g., a high-performance liquid chromatograph (HPLC)), a gas chromatograph (GC), an ion chromatograph, a capillary electrophoresis system, and the like. Components separated by the separation system are delivered to mass spectrometer 100 for mass analysis by mass spectrometer 100.

Figure 2:
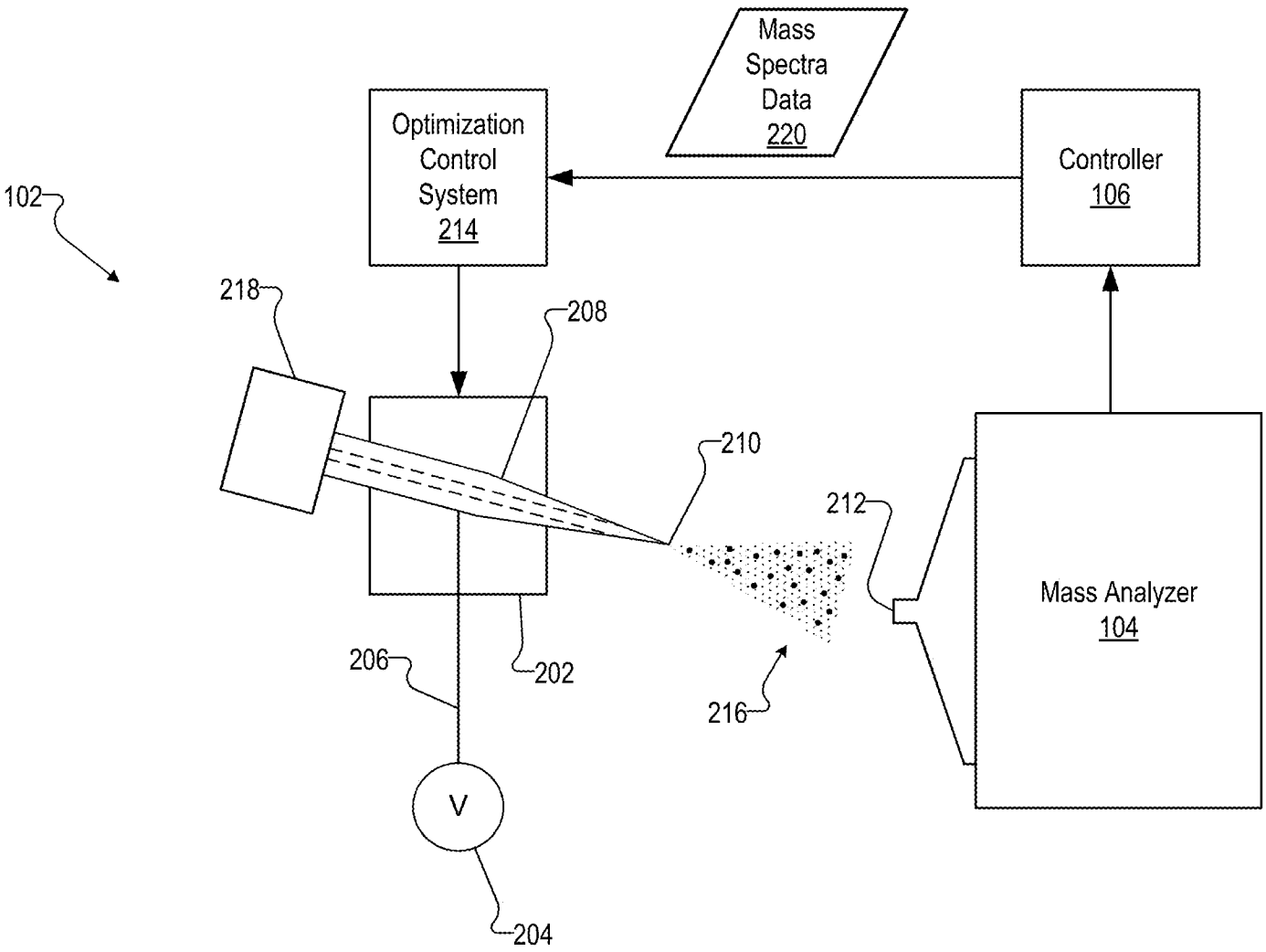
FIG. 2 shows a functional diagram of an illustrative implementation of an ion source included in the mass spectrometer of FIG. 1.

FIG. 2 shows a functional diagram of an illustrative implementation of ion source 102. FIG. 2 is merely illustrative, as ion source 102 may have any other suitable configuration. As shown, ion source 102 includes an automated motion system 202, a high voltage source 204, and a high voltage line 206. Ion source 102 may also include additional or alternative components not shown in FIG. 2 as may serve a particular implementation, such as a source housing (e.g., that houses components of ion source 102 and/or attaches to mass analyzer 104), cameras, adapters, locks, mounting components, gas supply lines, and the like.

Automated motion system 202 is configured to hold an emitter 208 having a tip 210 at a controlled distance (e.g., about 1-3 cm) from an inlet 212 to mass analyzer 104. When emitter 208 is mounted on automated motion system 202, automated motion system 202 may automatically adjust the position of emitter 208 (e.g., the position of tip 210) relative to inlet 212 in response to control signals received from an optimization control system 214 ("control system 214"). Operations of control system 214 and feedback control of automated motion system 202 will be described below in more detail. Automated motion system 202 may include any suitable mechanical and/or electrical components (e.g., actuators, gears, motors, shafts, cranks, slides, stages, etc.) configured to translationally and/or rotationally adjust a position of emitter 208 with anywhere from one to six degrees of freedom. In some examples, emitter 208 is mounted to a movable carriage of automated motion system 202, and the movable carriage may be moved by a precision motion system, an XYZ robot, an XYZ manipulator, one or more linear translation stages, one or more rotational stages, one or more piezoelectric actuators, and/or any combination of the foregoing.

Emitter 208 may be a needle or a capillary tube configured for electrospray ionization. Emitter 208 may be formed, for example, of glass, stainless steel, borosilicate, or any other suitable material. In some examples, emitter 208 is configured for the low flow rates of NSI (e.g., from about 10-50 nL/min up to about 1000-1500 nL/min). In other examples, emitter 208 is configured for capillary flow rates (e.g., from about 1 μL/min up to about 10-20 μL/min), microflow rates (e.g., from about 10 μL/min up to about 100 μL/min), or conventional ESI analytical flow rates (e.g., greater than about 50 μL/min). Emitter 208 may be included in an emitter cartridge that may include, without limitation, a mounting unit for holding emitter 208 and mounting to automated motion system 202 (e.g., a mounting arm that may couple to a movable carriage of automated motion system 202), adapters for connecting or integrating emitter 208 with a separation system (e.g., an LC or GC analytical column), onboard nonvolatile memory (which may store position data and/or other data that may be used for positioning of emitter 208), and/or any other suitable components. In some examples in which the emitter cartridge includes onboard memory, emitter cartridge may be communicatively coupled with control system 214, such as by way of a wired or wireless connection.

A mobile phase source 218 provides a mobile phase that flows through emitter 208. The mobile phase may include a sample in a solvent. Mobile phase source 218 may include, for example, a mobile phase pump, a syringe pump, a separation system (e.g., an LC or GC system), a container, or any other suitable source or combination of sources of a mobile phase. When ion source 102 is used for NSI, the mobile phase flows through emitter 208 under nanoscale flow rates ranging from about 10 nL/min up to about 1000 or 1500 nL/min.

Voltage source 204 is configured to apply a direct current spray voltage (e.g., about 2-6 kilovolts (kV) for ESI or about 0.7-1.1 kV for NSI) to emitter 208 or the mobile phase by way of high voltage line 206 (e.g., an electrical cable or other wiring or electrical connection). The spray voltage produces a strong electric field at tip 210 of emitter 208. (Alternatively, the electric field may be generated by applying the high voltage to mass analyzer inlet 212 with emitter 208 at ground.) The electric field excites analyte ions in the solvent as the analyte ions are emitted from tip 210, resulting in electrohydrodynamic disintegration of the mobile phase, generation of droplets, and formation of a spray plume 216 that travels toward inlet 212 of mass analyzer 104.

Mass analyzer 104 receives the analyte ions in spray plume 216 that enter inlet 212 and performs a mass analysis of the analyte ions. As explained above, controller 106 may process the received signals and construct mass spectra of the sample based on the signals detected by the ion detector in mass analyzer 104. Control system 214 may receive data representative of the mass spectra ("mass spectra data 220") generated by controller 106 and use mass spectra data 220 to control automated motion system 202 to adjust a position of emitter 208 relative to inlet 212. While FIG. 2 shows that control system 214 is separate from controller 106, in some examples control system 214 may be implemented, in whole or in part, by controller 106 and/or automated motion system 202.

In some examples, emitter 208 may be inserted in a nozzle and a sheath gas may flow coaxially around emitter 208 within the nozzle. As the mobile phase exits tip 210 the sheath gas flows around spray plume 216, thereby controlling the position and shape of spray plume 216 and reducing the stratification of mass. The sheath gas flow rate may be adjusted to achieve a desired position and shape of spray plume 216.

Figure 3:
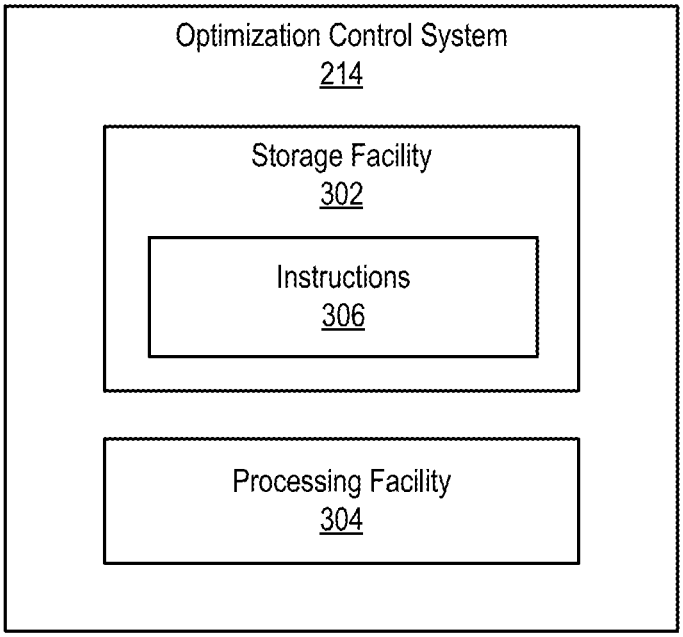
FIG. 3 shows an illustrative functional diagram of an optimization control system.

FIG. 3 shows an illustrative functional diagram of control system 214. Control system 214 may be implemented separately from mass spectrometer 100. In some examples, control system 214 may be implemented entirely or in part by mass spectrometer 100 (e.g., by controller 106, by automated motion system 202, or any other component of mass spectrometer 100) and/or by an emitter cartridge.

Control system 214 may include, without limitation, a storage facility 302 and a processing facility 304 selectively and communicatively coupled to one another. Facilities 302 and 304 may each include or be implemented by hardware and/or software components (e.g., processors, memories, communication interfaces, instructions stored in memory for execution by the processors, etc.). In some examples, facilities 302 and 304 may be distributed between multiple devices and/or multiple locations as may serve a particular implementation.

Storage facility 302 may maintain (e.g., store) executable data used by processing facility 304 to perform any of the operations described herein. For example, storage facility 302 may store instructions 306 that may be executed by processing facility 304 to perform any of the operations described herein. Instructions 306 may be implemented by any suitable application, software, code, and/or other executable data instance.

Storage facility 302 may also maintain any data acquired, received, generated, managed, used, and/or transmitted by processing facility 304. For example, storage facility 302 may maintain mass spectra data 220 and/or optimization algorithm data. Optimization algorithm data may include data representative of, used by, or associated with one or more optimization algorithms maintained by processing facility 304 for optimizing signals acquired by mass spectrometer 100 and positioning emitter 208 relative to inlet 212.

Processing facility 304 may be configured to perform (e.g., execute instructions 306 stored in storage facility 302 to perform) various processing operations described herein. It will be recognized that the operations and examples described herein are merely illustrative of the many different types of operations that may be performed by processing facility 304. In the description herein, any references to operations performed by control system 214 may be understood to be performed by processing facility 304 of control system 214. Furthermore, in the description herein, any operations performed by control system 214 may be understood to include control system 214 directing or instructing another system or device to perform the operations.

In some examples, control system 214 is configured to automatically tune ion source 102 to optimize the quality of the signal detected by mass spectrometer 100 (the "MS signal"). The quality of the MS signal may be indicated by the value of one or more figures of merit of the MS signal, such as intensity (e.g., intensity of one or more target analytes, selected m/z, or m/z range, a total ion current, etc.), signal-to-noise ratio ("SNR") (e.g., SNR for one or more target analytes or selected m/z or m/z range), the relative standard deviation ("RSD") (e.g., RSD for one or more target analytes or selected m/z or m/z range), the limit of detection (LOD) (e.g., the instrument detection limit (IDL) or the method detection limit (MDL)), and/or any other suitable figure of merit representative of a quality of the MS signal. The RSD of the detected signal represents stability of the detected signal (e.g., the amount of variability in MS signals).

As explained above, the quality of the MS signal may depend on certain user-configurable parameters, such as the position of emitter tip 210 relative to inlet 212, the spray voltage applied to emitter 208, a sheath gas flow rate (in implementations using a sheath gas), a flow rate of a mobile phase flowing to emitter 208, and/or a composition of a solvent in the mobile phase. In an NSI ion source the optimum position of emitter tip 210 may be a fraction of a millimeter wide on all sides. The quality of the MS signal may also depend on other factors that may not be easily controlled by a user, such as ambient conditions (e.g., temperature, ambient air flow, humidity, pressure, etc.), instrument characteristics (e.g., inlet geometry, etc.), and the like. Accordingly, control system 214 may perform various operations to automatically tune ion source 102 to improve or optimize a figure of merit (e.g., intensity, SNR, RSD, and/or LOD) of the MS signal, as will now be described.

As used herein, "optimize" and its variants means to seek a best solution among a set of possible solutions, although the best solution may not necessarily be obtained, such as when an optimization process is terminated (e.g., based on satisfaction of a stop criterion) prior to finding the best solution, when multiple solutions exist that satisfy predefined criteria, or when a selected optimization technique is unable to converge on the best solution. Similarly, as used herein an "optimum" parameter (e.g., a "maximum" value of a parameter) means the solution obtained as the result of performing an optimization process, and thus may not necessarily be the absolute extreme value of the parameter (e.g., the absolute maximum or minimum), but still adjusts the parameter and results in an improvement.

In some examples, control system 214 may tune ion source 102 to optimize a figure of merit of the MS signal by controlling automated motion system 202 to adjust a position of tip 210 of emitter 208 relative to inlet 212 based on mass spectra data 220 acquired by mass spectrometer 100. To this end, control system 214 may determine 3D coordinates (or 2D coordinates when emitter 208 is adjustable along only two axes) of an optimum position of emitter 208 relative to inlet 212. An optimum position of emitter 208 refers to the position of emitter tip 210 relative to inlet 212 that results in an optimum value of the particular figure of merit.

A position of emitter 208 may be determined with reference to emitter 208 (e.g., emitter tip 210 or a marker on emitter 208), to the emitter cartridge, or to a movable carriage of automated motion system 202. For example, when emitter 208 is mounted to automated motion system 202 the exact position of emitter tip 210 relative to inlet 212 may not be known since such position may vary across different users, installations, and emitters. Accordingly, the position of emitter 208 (e.g., the position of emitter tip 210) relative to inlet 212 may refer to the position (e.g., 3D coordinates) of the movable carriage of automated motion system 202 to which emitter 208 is mounted since the position of emitter 208 is fixed relative to the movable carriage. Control system 214 may track the position of the movable carriage in any suitable way, such as by kinematics.

In alternative examples, the position of emitter 208 may be determined with reference to emitter 208, the emitter cartridge, or the automated motion system by using a depth sensor (e.g., a time-of-flight sensor, an infrared sensor, etc.), interferometer, or computer vision. For example, ion source 102 may include a camera configured to capture images of emitter 208 and determine, based on the captured images, a position of emitter tip 210. In some examples, emitter 208 (or the emitter cartridge) may include a marker (e.g., a reflective sticker) that may be recognized by image recognition and used to determine the position of emitter 208. When the position of the camera relative to inlet 212 is not fixed or is not known, the position of emitter 208 relative to inlet 212 may be determined based on image recognition of both emitter 208 and inlet 212. In yet further examples, the position of emitter 208 may be determined by means of an optical lever.

Control system 214 may determine the optimum position of emitter 208 relative to inlet 212 in any suitable way. In some examples, determining the optimum position of emitter 208 is an optimization problem. An optimization problem generally uses an optimization model in which an objective function represents a value of a parameter to be optimized as a function of one or more variables (e.g., controllable inputs) and any constraints. An optimization problem may be solved by finding a maximum (or minimum) value of the objective function by choosing values of the variables from within an allowed set (e.g., that satisfies any constraints) and computing the value of the objective function. In some examples, the objective function is not known but may be measured.

In the examples that follow, control system 214 may determine the optimum position of emitter 208 by using an optimization algorithm in which the objective function represents any suitable figure of merit of the MS signal, such as intensity, SNR, RSD, and/or LOD, and the variables include one or more of the position of emitter 208 relative to inlet 212, the spray voltage, and/or the sheath gas flow rate. The objective function may be measured by acquiring mass spectra at various values of emitter position, spray voltage, and/or sheath gas flow rate.

Figure 4:
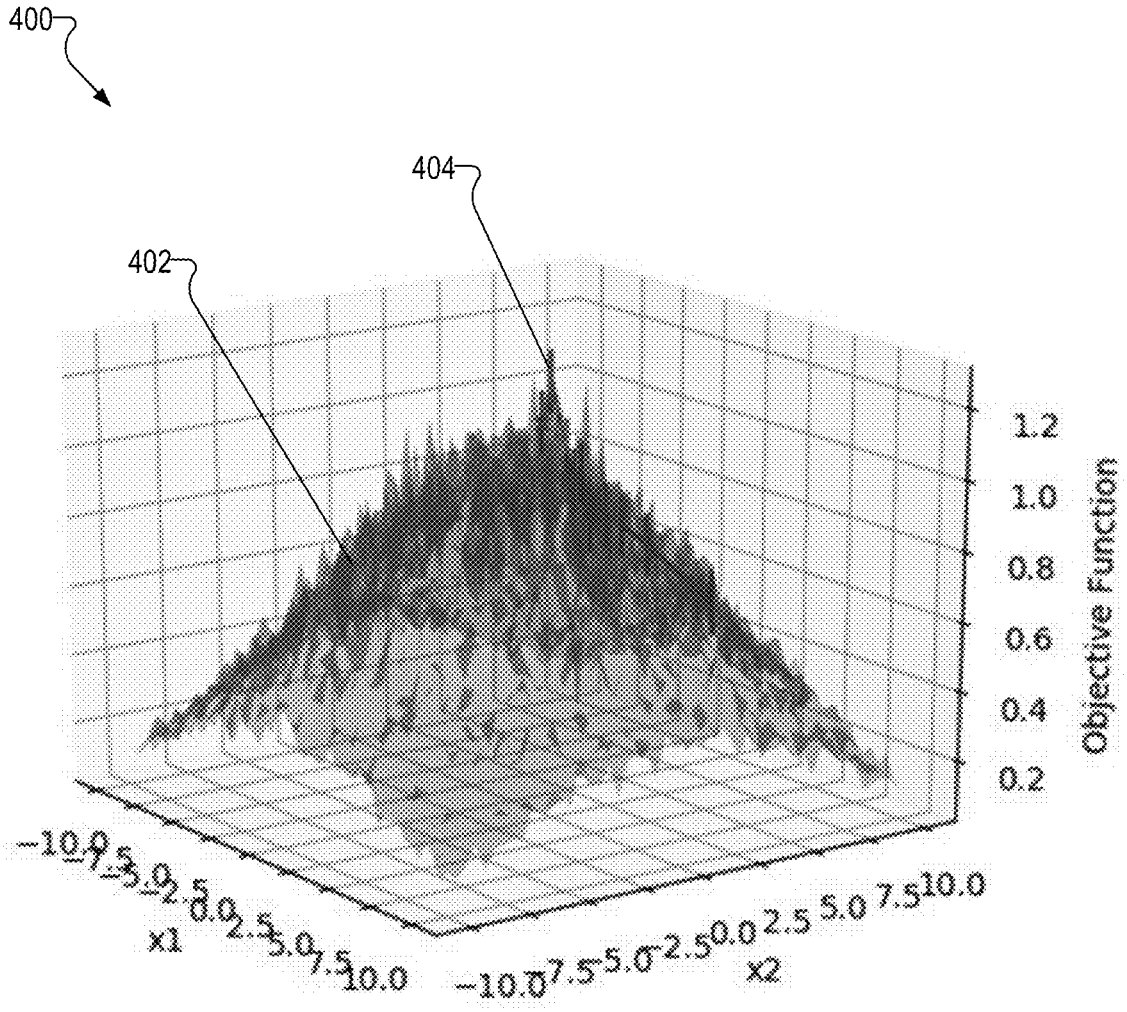
FIG. 4 shows a graph depicting an illustrative objective function that may represent a figure of merit of an MS signal.

FIG. 4 shows a graph 400 depicting an illustrative objective function 402 that may represent a figure of merit of an MS signal (e.g., intensity) on the z-axis (vertical axis) as a function of model variables $x_1$ and $x_2$ (on the x- and y-axes). The variables $x_1$ and $x_2$ may represent, for example, spatial coordinates (e.g., x and y and z coordinates, respectively) and/or any other suitable variables (e.g., sheath gas flow rate, spray voltage, etc.). As shown, objective function 402 is convex and has a global maximum 404. Global maximum 404 may be identified by mapping the entire objective function 402, but such a mapping procedure is time-consuming and inefficient. Accordingly, rather than mapping objective function 402, as shown in FIG. 4, control system 214 may iteratively optimize objective function 402 using an iterative optimization algorithm.

Any suitable iterative optimization algorithm may be used as may serve a particular implementation, taking into account the inherent noisiness of MS signals due to intrinsic characteristics of the ion source and/or detector. Noise is intrinsic to mass spectrometry, even with ideal emitters and extreme sample purity. The (relative) magnitude of the noise fluctuation is greater at lower intensity (e.g., when the emitter is positioned away from an optimum position), and there is a tradeoff between acquisition time for an analyte and noisiness (e.g., longer acquisition times have a higher intensity). In some examples, such as when the analyte intensity is relatively high or the acquisition speed is slow (e.g., on the order of seconds to tens of seconds per acquisition), the optimization algorithm may be a deterministic algorithm, such as a gradient descent (or gradient ascent) algorithm. However, given that MS signals are inherently noisy (see, e.g., objective function 402) and that high analyte intensity or slow acquisition speeds may present other problems, a stochastic optimization algorithm may be preferable. The recursive update rules of stochastic optimization algorithms can be used for approximating optimum values of objective functions which cannot be computed directly but only estimated via noisy measurements.

Suitable stochastic optimization algorithms may include, without limitation, stochastic gradient descent, a stochastic approximation, a finite-difference stochastic approximation (e.g., the Kiefer-Wolfowitz algorithm), a simultaneous perturbation stochastic approximation, a response-surface methodology (RSM), and/or any variation or combination of the foregoing. Suitable stochastic optimization algorithms incorporate randomness (e.g., noise) in the objective function, although in some examples the stochastic optimization algorithm may also include random search methods and/or random walks.

Figure 5:
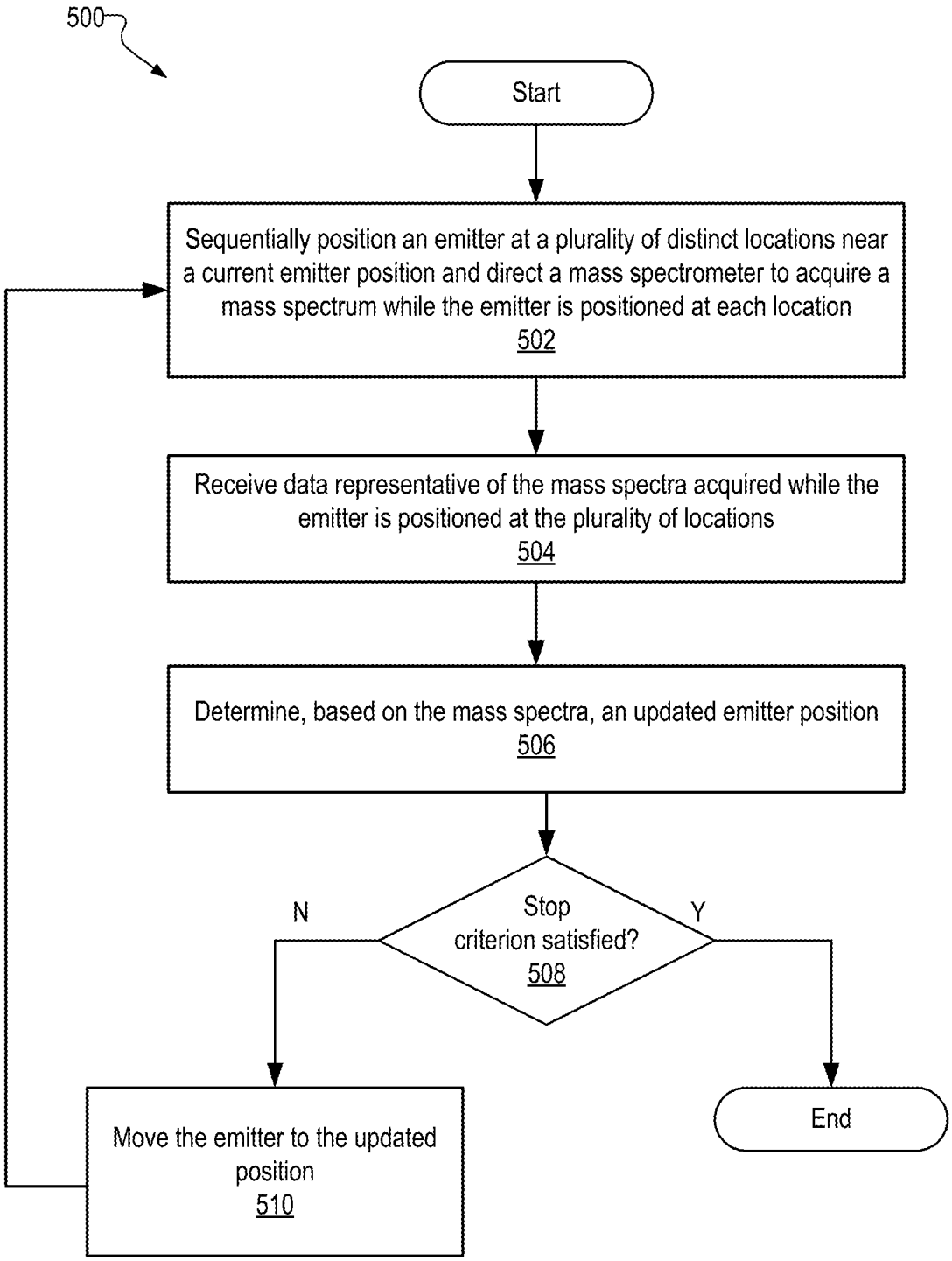
FIG. 5 shows a flowchart of an illustrative method for iteratively optimizing a position of emitter relative to a mass spectrometer inlet using an optimization algorithm.

FIG. 5 shows a flowchart of an illustrative method 500 for iteratively optimizing a position of emitter 208 relative to inlet 212 using an optimization algorithm (e.g., a stochastic optimization algorithm). While FIG. 5 shows illustrative operations according to one embodiment, other embodiments may omit, add to, reorder, and/or modify any of the operations shown in FIG. 5. While FIG. 5 describes operations performed by control system 214, any of the operations may alternatively be performed by mass spectrometer 100 and/or any other apparatus.

Method 500 may be performed to optimize the position of emitter 208 for one or more target analytes. The target analyte or analytes used for optimizing can be a solvent, a mobile phase additive, or a cluster of any combination of solvents or additives. Use of mobile phase background ions allows method 500 to be performed with the same flow used to condition a separation system column and without performing a sample injection. In some examples the target analyte or analytes may be included in a calibrant stock. In other examples the target analyte may be included in an infusion cartridge for a calibration of mass spectrometer 100. The infusion cartridge may be connected to a syringe pump that provides calibrant ions, any one or more of which may be used as the target analyte or analytes.

Operations 502 to 510 may be performed for each iteration. When method 500 begins, emitter 208 is positioned at an initial position. In some examples, the initial position may be a default home position for the particular instruments being used (e.g., the particular mass spectrometer, ion source, or emitter cartridge). Alternatively, the initial position may be a default home position for the particular experiment conditions (e.g., the particular target analyte or analytes, selected m/z or m/z range, solvent conditions, sheath gas flow rate, and/or spray voltage). The default home position may be determined empirically, such as by performing method 500. In some examples, an emitter cartridge may include onboard nonvolatile memory that may store data representative of the default home position (coordinates) that may be read and used by control system 214 to position emitter 208 at the initial position. Alternatively, control system 214 may obtain the data representative of the default home position from a remote computing system.

In operation 502, control system 214 samples a search area to acquire mass spectra data to be used to identify a step direction and/or a step size for an iterative step on the objective function. To sample the search area control system 214 sequentially positions emitter 208 at a plurality of distinct locations near the current emitter position (e.g., by controlling automated motion system 202) and directs mass spectrometer 100 to acquire a mass spectrum (or mass spectra) while emitter 208 is positioned at each location included in the plurality of distinct locations. Thus, for N distinct locations mass spectrometer 100 may acquire N mass spectra. In some examples mass spectrometer 100 may acquire more than one mass spectrum for each distinct location. The plurality of locations at which emitter 208 is sequentially positioned may be determined in accordance with the optimization algorithm.

In some examples, the size of the search area and/or the scale over which to search are hyperparameters of the optimization algorithm and may be fixed, chosen from a schedule, determined adaptively, and/or dynamically modified during the optimization process in order to make method 500 robust against noise.

In operation 504, control system 214 receives, from mass spectrometer 100 (e.g., from controller 106), data representative of the set of mass spectra acquired in operation 502. This set of mass spectra data may be a subset of mass spectra data 220 (see FIG. 2). Operation 504 may be performed in any suitable way.

In operation 506, control system 214 determines, based on the mass spectra acquired in operation 502 and in accordance with the optimization algorithm, an updated position for emitter 208. For example, control system 214 determines a step direction and/or a step size of a step on the objective function and determines the updated position (coordinates) for emitter 208 based on the determined step. The step direction and/or step size and the corresponding updated emitter position may be determined by the optimization algorithm based on the currently measured values of the objective function (e.g., the measured intensity, SNR, RSD, or LOD). In some examples, some randomness can be used in the determination of the step direction and/or step size. For example, the optimization algorithm may incorporate a random search or random walks.

In some examples, the step size is a hyperparameter of the optimization algorithm that may be fixed, chosen from a schedule, determined adaptively, and/or dynamically modified during the optimization process. Large step sizes may make method 500 robust against noise, while smaller step sizes may prevent method 500 from overshoot the optimum. In some examples, the step size is constant throughout the iterative optimization method. In other examples, the step size may be configured to decay (e.g., exponentially) with each iteration or otherwise vary as the optimization method nears the maximum so as to remain close to the optimum.

In operation 508, control system 214 determines whether a stop criterion has been satisfied. Illustrative strop criteria are described below in more detail. If control system 214 determines that a stop criterion has not been satisfied, method 500 proceeds to operation 510. In operation 510, control system 214 controls automated motion system 202 to move emitter 208 to the updated emitter position identified in operation 506. Control system 214 then returns to operation 502 to perform another iteration.

If, however, control system 214 determines that a stop criterion has been satisfied, control system 214 terminates method 500. When method 500 is terminated, emitter 208 remains at its current position (e.g., the updated position identified in operation 506 of the immediately prior iteration). Accordingly, method 500 may be used by control system 214 to iteratively adjust the position of emitter 208 until the MS signal has been optimized.

Any suitable stop criterion (or criteria) may be used as may serve a particular implementation. In some examples, the stop criterion comprises completion of a predetermined number of iterations. For example, control system 214 may track the number of iterations performed in method 500 and terminate method 500 when the number of iterations matches a threshold number (e.g., ten).

In additional or other examples, the stop criterion comprises a minimum threshold step size. In this example, the step sizes may progressively decrease as the steps near the maximum of the objective function. As a result, a certain small step size may be presumed to be indicative of having reached the maximum value of the objective function. In a modified example, the stop criterion comprises performing a minimum number (e.g., 3) of sequential steps each having a step size that is less than or equal to the minimum threshold step size.

In another example, the stop criterion may be based on probabilities of the step direction of the next step. For example, control system 214 may determine the probabilities of a backward step and a forward step and compare these probabilities. The step direction probabilities may be determined in any suitable way and may be agnostic of the step size. If the probabilities are about equal (e.g., within an acceptable tolerance or threshold range of each other that may be set, such as within 1%, 0.1%, etc.), control system 214 may terminate method 500.

In yet further examples, the stop criterion may comprise a determination that the objective function has stopped improving. For example, control system 214 may determine whether the figure of merit for the mass spectra acquired during a current iteration are better than the figure of merit for the mass spectra acquired during a prior iteration. In response to a determination that the figure of merit for the mass spectra acquired during the current iteration is not better than the figure of merit for the mass spectra acquired during the prior iteration, control system 214 may terminate method 500. Control system 214 may compare the figure of merit for mass spectra from different iterations in any suitable way, such as by applying one-way analysis of variance ("ANOVA"), the Mann-Whitney U test, the Student's-t test, and/or any other suitable statistical population-based comparison method.

In some examples, upon terminating method 500, control system 214 may store data representative of the optimum emitter position in the onboard memory of the emitter cartridge and/or in a storage facility of mass spectrometer 100. Additionally or alternatively, control system 214 may transmit the data representative of the optimum emitter position to a remote computing system, which may use the data alone or in combination with data received from other optimizations to establish a default home position for the particular experiment conditions.

Figure 6:
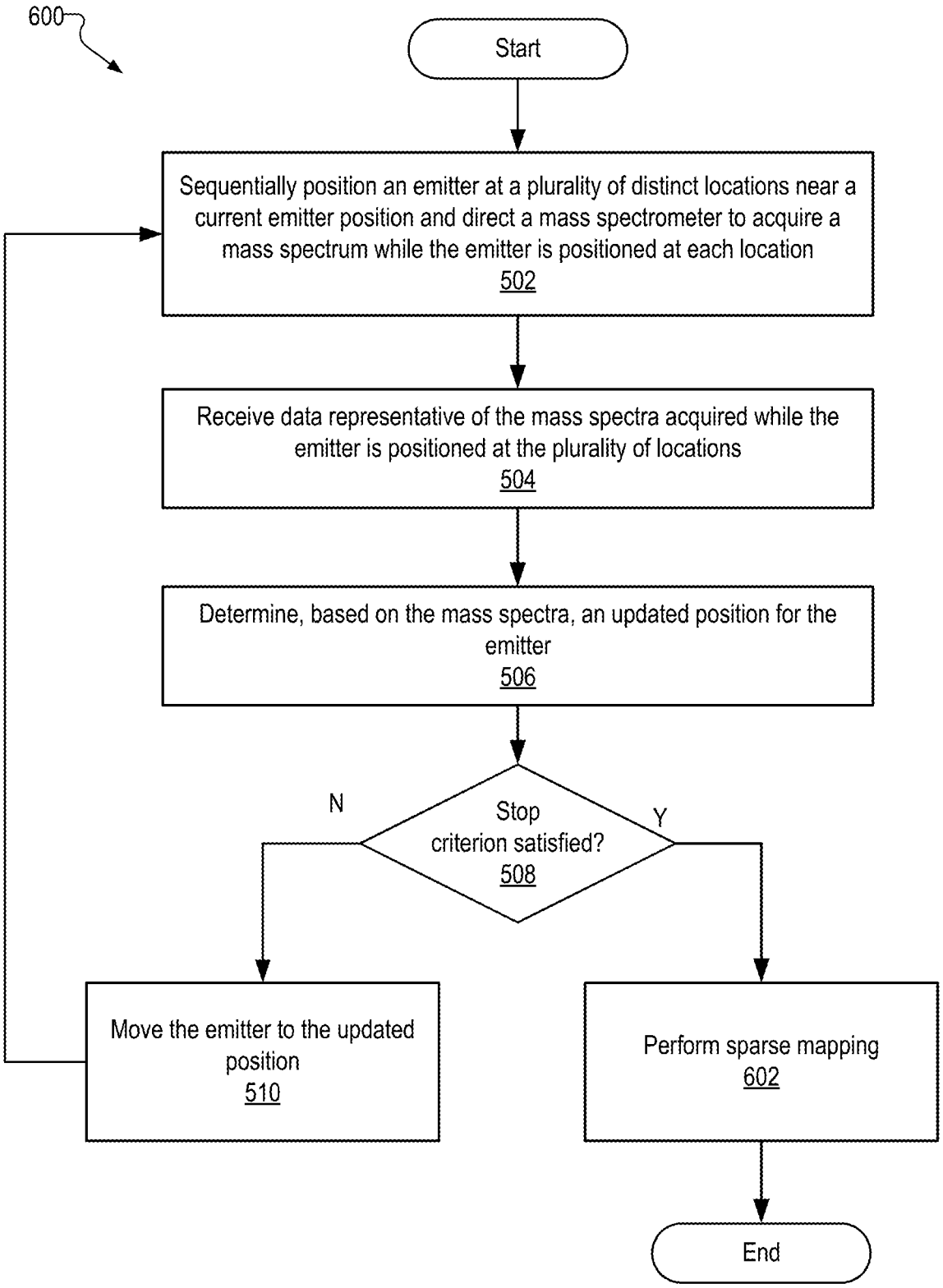
FIG. 6 shows a flowchart of another illustrative method for iteratively optimizing the position of the emitter relative to the mass spectrometer inlet.

FIG. 6 shows a flowchart of another illustrative method 600 for iteratively optimizing a position of emitter 208 relative to inlet 212. Method 600 is similar to method 500 except that method 600 includes an additional operation 602 that may be performed when control system 214 determines that a stop criterion has been satisfied (operation 508 (Y)). In some examples, control system 214 performs operation 602 only if the figure of merit does not meet a threshold value (e.g., a minimum intensity or SNR threshold or a maximum RSD threshold).

In operation 602, control system 214 performs a sparse mapping procedure (similar to a response surface iteration) in which control system 214 fine-tunes the optimum position of emitter 208. For example, control system 214 may map the objective function in a small region around the optimum of the objective function identified by iteratively performing operations 502 to 510. To this end, control system 214 may direct mass spectrometer 100 to sample a small region around the current position of emitter 208 while automated motion system 202 moves emitter 208 (e.g., along the principal axes). The small region may be any size as may suit a particular implementation. In some examples, the small region has a radius smaller than the step size of a most recent iteration. While mapping a large region in front of inlet 212 to find the optimum emitter position may be time-consuming and thus cost-prohibitive, mapping the small region after completion of the optimization algorithm can performed quickly and efficiently.

After mapping the small region, control system 214 may fit a parabolic function to the mass spectra acquired during the sparse mapping and find the maximum of the parabolic function. Control system 214 may identify a final position for emitter 208 based on the maximum of the parabolic function and control automated motion system 202 to move emitter 208 to the final position. In this way, control system 214 may use a stochastic optimization algorithm to perform a coarse adjustment of the emitter position to optimize the MS signal and may use a sparse mapping operation to perform a fine adjustment of the emitter position to further optimize the MS signal.

Figure 7:
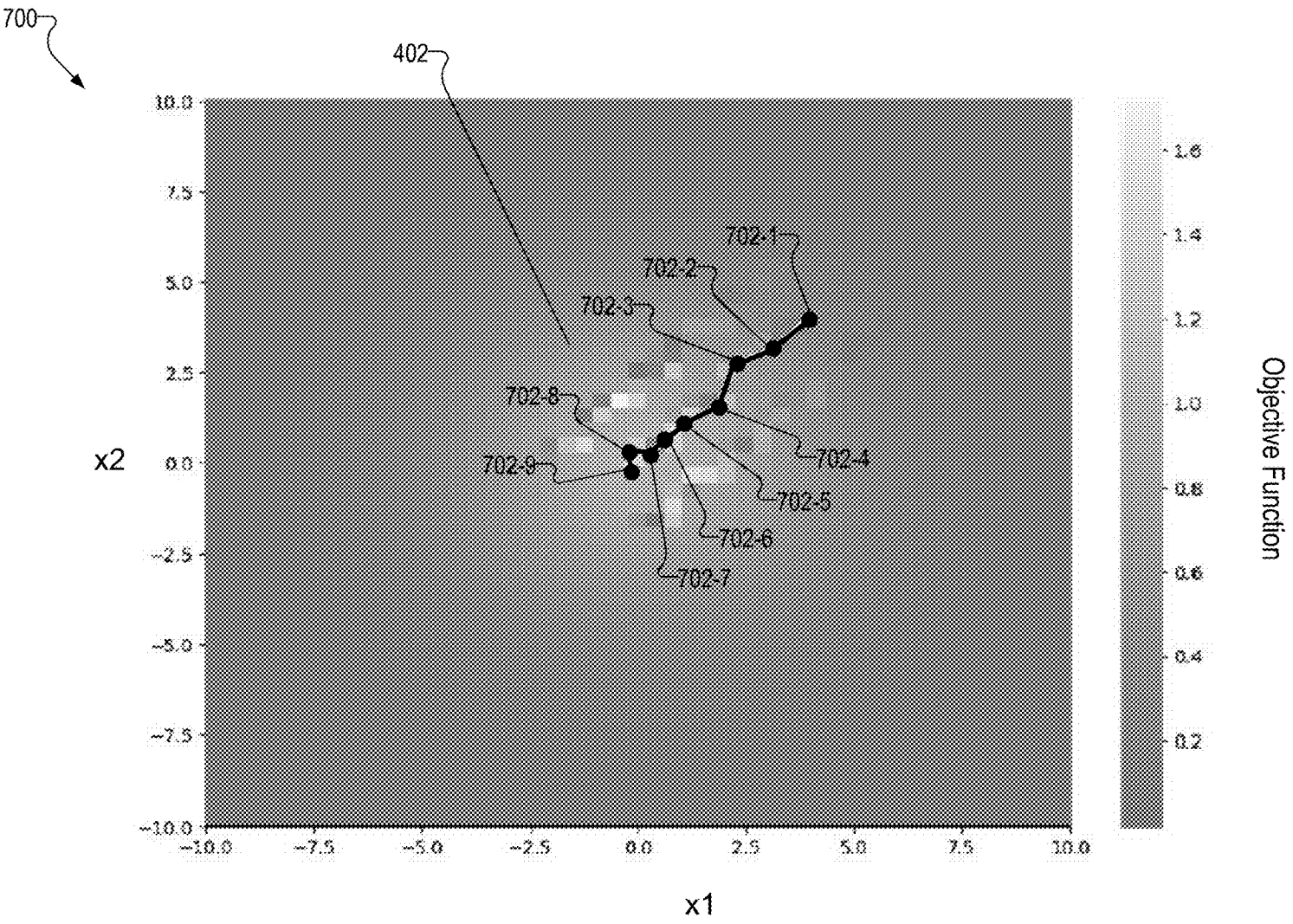
FIG. 7 shows a simulated progression of the methods of FIGS. 5 and 6 with reference to a two-dimensional representation of the objective function shown in FIG. 4.

FIG. 7 shows a simulated progression of method 500 or method 600 with reference to a two-dimensional representation 700 of objective function 402. While objective function 402 is generally not known during an actual experiment, objective function 402 is shown in FIG. 7 to illustrate operation of method 500. While objective function 402 shown FIG. 4 is generally noisy, for ease of understanding FIG. 7 generally does not show noise except whenever and wherever objective function 402 is sampled.

As shown in FIG. 7, the value of objective function 402 measured in a first iteration is represented by point 702-1 on objective function 402. In the first iteration, emitter 208 a search area is sampled by acquiring mass spectra while emitter 208 is positioned at a plurality of distinct locations. Based on the search, a step is taken to a next point 702-2 on objective function 402, and a new search area is sampled. The process is iteratively repeated from point 702-2 to point 702-9 until control system 214 determines that a stop criterion is satisfied. Point 702-9 represents an optimum of the objective function, and thus the position of emitter 208 at point 702-9 is positioned at an optimum position.

In methods 500 and 600, some iterations may produce a step that results in a loss of MS signal or a significant reduction in the MS signal quality (e.g., a reduction of intensity or SNR or increased RSD). For example, mass spectra acquired during an iteration may result in adjustment of emitter 208 to an updated position that is unable to produce a useful (e.g., detectable) MS signal for the target analyte or analytes in a subsequent iteration. Such missteps may be caused, for example, by the optimization method as a result of extreme or rare events. For instance, the particular combination of multiple samples acquired during an iteration could steer the optimization in a totally wrong direction. Noisy measurements may also be compounded by a poor choice of optimization algorithm hyperparameters, such as step size, search area, and/or search scale. Missteps may also be caused by physical conditions (e.g., a brief problem at the ion source causing a dropout or a sputter, a bubble in the transfer line, etc.). For instance, the optimization process could be proceeding "uphill" toward the global optimum but the intensity of the acquired MS signal at a point in front of (uphill from) the current point is briefly low when the signal is acquired. As a result, the optimization algorithm may determine that the point in front of the current point is "downhill" and thus turn around and take a step in a different direction. To address these problems, the optimization algorithm may further include a recovery process to recover a quality MS signal and resume optimization of the MS signal, as will now be described.

Figure 8:
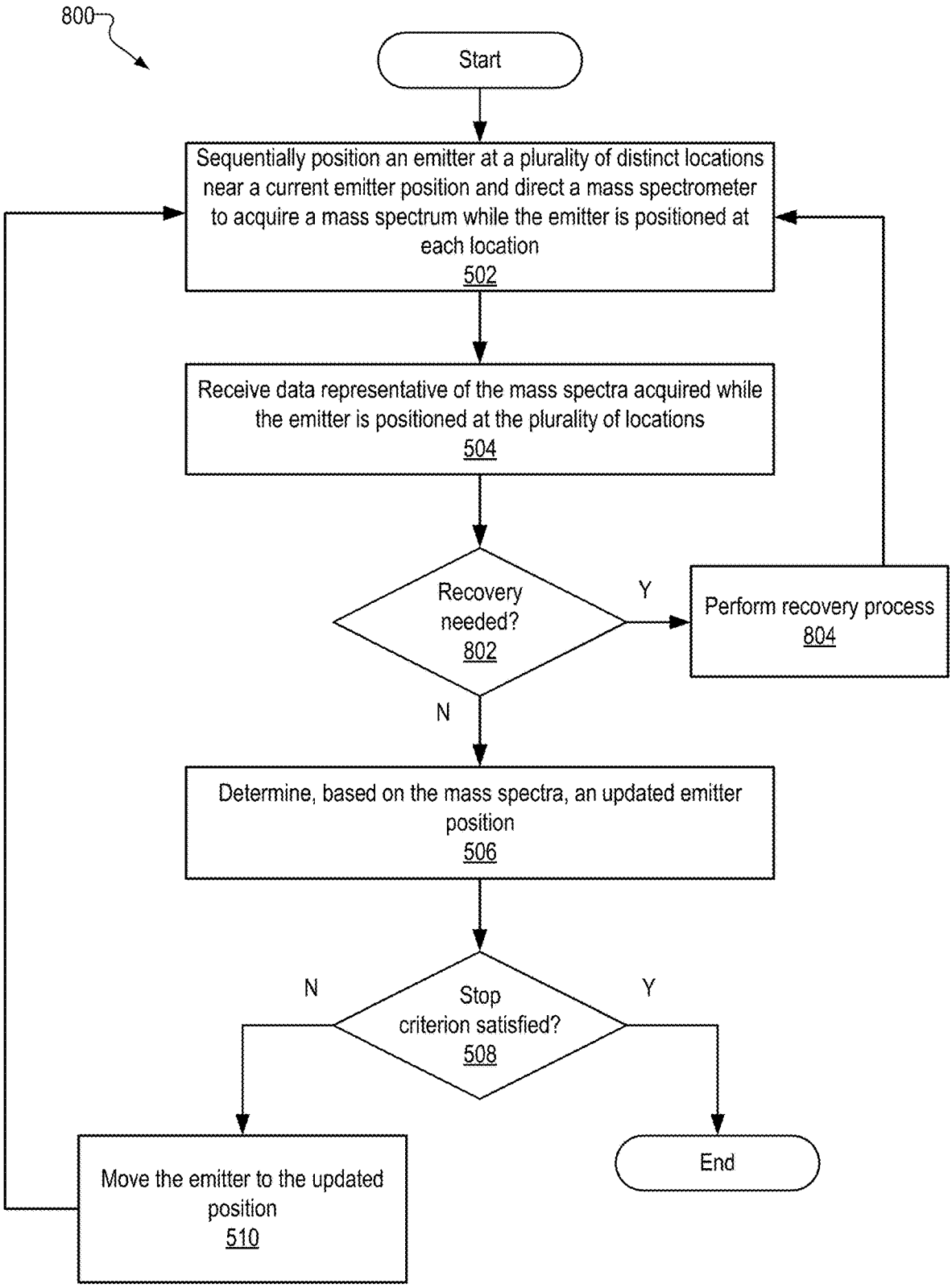
FIG. 8 shows a flowchart of another illustrative method for iteratively optimizing the position of the emitter relative to the mass spectrometer inlet.

FIG. 8 shows a flowchart of another illustrative method 800 for iteratively optimizing a position of emitter 208 relative to inlet 212. Method 800 is similar to method 500 except that method 800 includes a recovery process comprising operations 802 and 804.

As shown in FIG. 8, operation 802 may be performed after operation 504. In operation 802, control system 214 determines whether a recovery process is needed. Operation 802 may be performed in any suitable way. For example, control system 214 may analyze the mass spectra data received in operation 504 and determine, based on the mass spectra, whether the objective function is not detectable or fails to satisfy a criterion (e.g., the SNR is below a minimum threshold value, the MS signal intensity is below a minimum threshold value, the RSD exceeds a maximum threshold value, the value of the objective function deviates from a measured value of the objective function in a prior iteration by more than a threshold amount, etc.). In response to determining that the measured objective function is not detectable or does not satisfy the criterion, control system 214 may determine that a recovery process is needed.

In some examples (not shown in FIG. 8), operation 802 may additionally or alternatively be performed after operation 506. In such examples, control system 214 may determine that a recovery process is needed when the step size and/or step direction calculated in operation 506 deviates from an expected step size and/or step direction and/or exceeds a threshold step size and/or step direction criterion. The expected step size and/or step direction may be based, for example, on a history of steps during the current optimization and/or based on one or more other prior optimizations. Similarly, the threshold step size may also be based on a history of prior optimizations.

If control system 214 determines that a recovery process is not needed, method 500 proceeds to operation 506 to continue the iterative optimization. If, however, control system 214 determines that a recovery process is needed, method 500 proceeds to operation 804.

In operation 804, control system 214 performs a recovery process. The recovery process may be performed in any suitable way. In some examples, recovery process 804 comprises adjusting the position of emitter 208 to a prior known good location. A "prior known good location" or "prior known good position" may be any prior location of emitter 208 at which the measured value of the objective function was better than the value of the objective function measured in one or more prior iterations. In some examples, the prior known good location is a last (most recent) known good location. In other examples, the prior known good location is a prior best location (e.g., the prior location at which at which the measured value of the objective function was better than in all other iterations).

Recovery process 804 may also include adjusting one or more hyperparameters of the optimization algorithm to ensure that the same path is not repeated. For example, control system 214 may adjust a step size, search area, and/or search scale hyperparameter of the optimization algorithm.

After moving emitter 208 to a prior known good location, processing returns to operation 502. By returning emitter 208 to a prior known good location, and by adjusting hyperparameters, missteps due to noise and/or suboptimal hyperparameters may be discarded and the optimization process may be put back on track.

In some examples, data representative of missteps may be stored and used to prevent future steps to the same misstep location. For example, if the updated emitter position determined in operation 506 is the same (or near) position of a prior misstep, control system 214 may instead perform a preventative operation to prevent the same misstep. For example, control system 214 may modify the determined step size by a fractional factor (e.g., one-half, one-third, one-fourth, etc.). Alternatively, control system 214 may perform a random step instead of the determined step.

In some examples, recovery process 804 may count the number of consecutive occurrences of performing recovery process 804. If the number of consecutive occurrences of recovery process 804 reaches a threshold limit, control system 214 may abort method 800 and alert a user, use a different prior known good location, start method 800 over with emitter 208 positioned at a location different from the initial location, take a random step from the current location or a prior known good location, and/or perform any other potentially mitigating operation.

In some scenarios, a misstep may cross over or pass nearby the optimum of the objective function. Accordingly, recovery process 804 may include incrementally moving the position of emitter 208 back toward a prior known good location through a series of intermediate positions and sampling a search area while emitter 208 is positioned at each intermediate location. Each incremental move may be, for example, a fraction (e.g., one-half, one-third, one-fourth, etc.) of the step size of the misstep but in the opposite direction of the misstep. If the measured objective function at an intermediate location is not as good as or better than at a prior position of emitter 208, control system 214 may repeat the process by making another incremental move back toward the prior known good location and again sampling an updated search area. This process may be repeated until emitter 208 reaches the prior known good location or until the measured objective function at an intermediate location is as good as or better than at the prior known good location. When either event occurs, control system 214 may terminate recovery process 804 and proceed to operation 506 to resume iterative optimization method 800.

Figure 9:
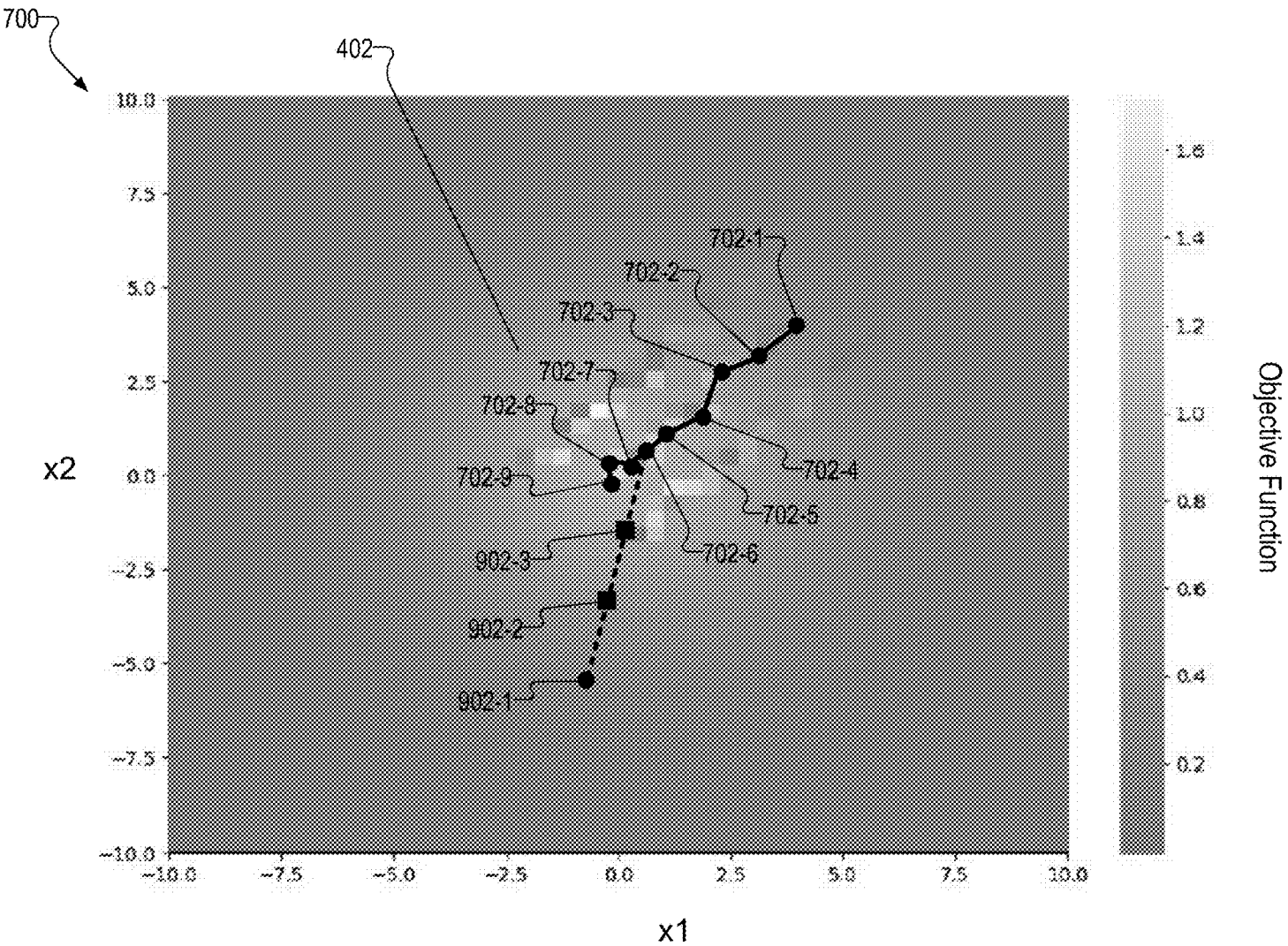
FIG. 9 shows a simulated progression of the method of FIG. 8 with reference to a two-dimensional representation of the objective function shown in FIG. 4.

FIG. 9 shows a simulated progression of method 800 with reference to two-dimensional representation 700 of objective function 402. FIG. 9 is similar to FIG. 7 except that in FIG. 9 a misstep (represented by the dashed line) is taken from point 702-6 to a point 902-1, followed by a recovery process. At point 902-1 control system 214 may determine that a recovery process is needed to recover the MS signal. In the recovery process, control system 214 may move emitter 208 to a position associated with the last known good point (e.g., point 702-6) and adjust one or more hyperparameters of the optimization algorithm, and then resume the optimization processing until the optimum of objective function 402 is identified at point 702-9.

Figure 10:
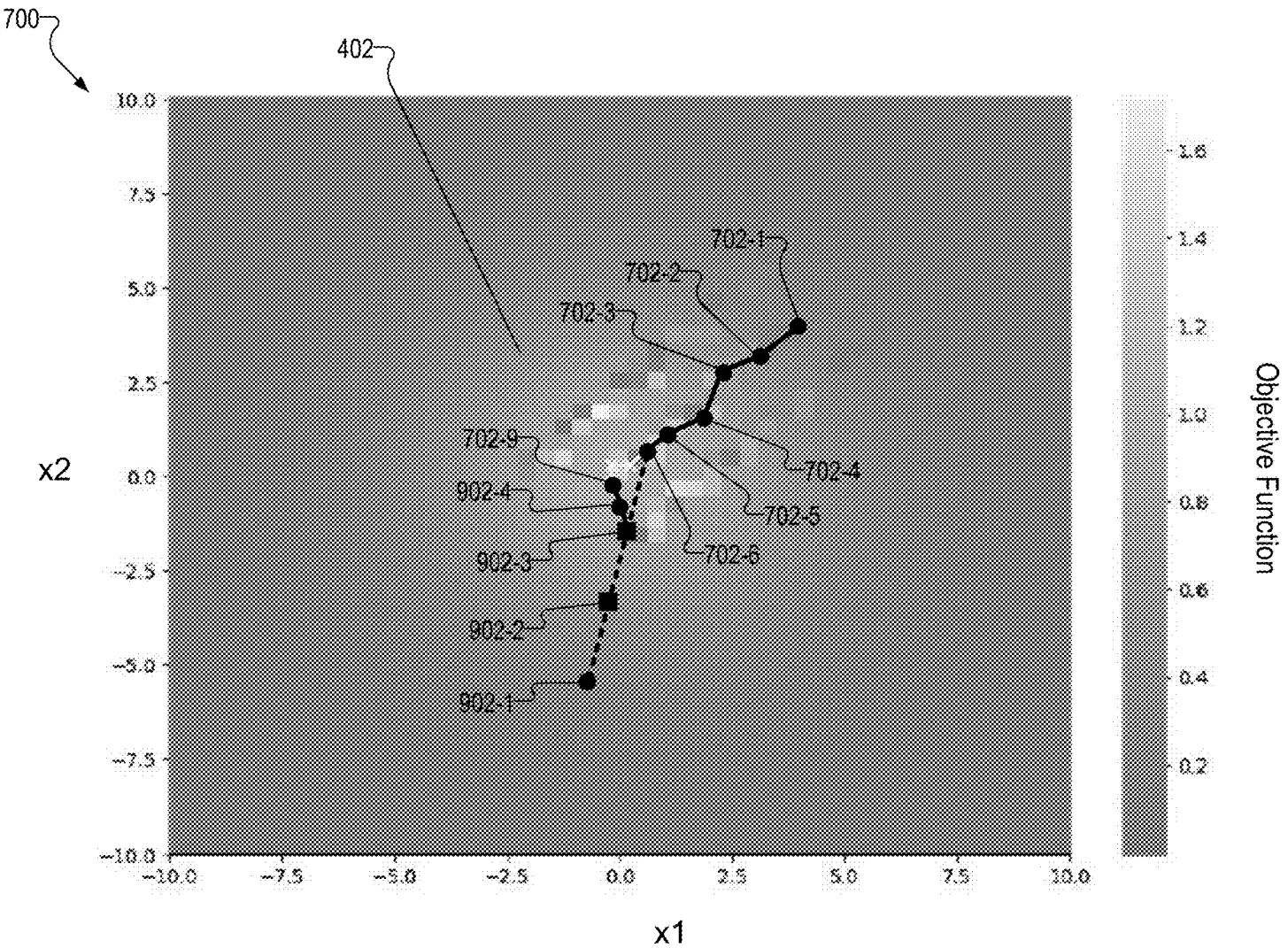
FIG. 10 shows another simulated progression of the method of FIG. 8 with reference to a two-dimensional representation of the objective function shown in FIG. 4.

FIG. 10 shows another simulated progression of method 800 with reference to two-dimensional representation 700 of objective function 402. FIG. 10 is similar to FIG. 9 except that, in the recovery process, control system 214 moves emitter 208 incrementally from a position associated with point 902-1 toward the last known good emitter position (e.g., a position associated with point 702-6) through multiple intermediate positions. Control system 214 samples the search area at each intermediate position. The values of the objective function measured at the intermediate positions are represented by points 902-2 and 902-3. At point 902-3, control system 214 determines that the measured objective function is as good as or better than the objective function measured at point 702-6 and thus resumes optimization processing, which proceeds though point 902-4 and finally terminates at point 702-9.

While methods 500, 600, and 800 have been described above as optimizing the position of emitter 208, methods 500, 600, and 800 may also optimize other ion source parameters, such as spray voltage, a flow rate of a mobile phase flowing to the emitter and/or a composition of a solvent in the mobile phase (such as in the case of an isocratic gradient), and/or a sheath gas flow rate. In some examples, control system 214 may optimize one or more additional parameters together with the emitter position. To this end, sampling (e.g., operation 502) may be performed over a small 4, 5, or n-dimensional hypercube. In alternative examples, control system 214 may optimize one or more additional parameters independently of the emitter position. This may be performed, for example, between iterations of emitter position optimization, or after optimization of the emitter position. For example, after identifying an optimal emitter position, control system 214 may then optimize the sheath gas flow rate, mobile phase flow rate, solvent composition, or spray voltage while emitter 208 is positioned at the optimal position.

As mentioned above, ion source 102 may be connected to a separation system (e.g., an LC system) and operated in an online mode. In the online mode, the composition of the mobile phase may change over time across a gradient of the effluent (e.g., an LC gradient). As a result, the optimum position of emitter 208 may also change with the gradient. Other optimum ion source settings may also change over time, such as the optimum spray voltage and/or optimum sheath gas flow rate. Accordingly, control system 214 may be configured to schedule adjustment of emitter 208 (e.g., a trajectory of emitter 208) and/or adjustment of other ion source settings to different positions and settings that are optimal at different times in gradient. To this end, control system 214 may optimize the position of emitter 208 and/or other ion source settings, as described above, for each different target analyte, selected m/z or m/z range, and/or for each different solvent condition that may be expected during the course of an analytical run. During the analytical run, control system 214 may adjust the ion source parameters in real time in accordance with the schedule.

Alternatively to scheduling a trajectory of emitter 208 and/or other ion source settings prior to performing an analytical run, control system 214 may optimize the emitter position and/or other ion source settings in real time during the analytical run as the mobile phase changes. For example, control system 214 may detect when the effluent from an LC column changes (e.g., when a particular analyte is detected or the intensity of the analyte reaches threshold level) and, in response, may optimize the emitter position and/or other ion source settings.

As mentioned above, control system 214 may optimize the MS signal based on analysis of two or more target analytes. For example, if a sample contains multiple target analytes to be analyzed concurrently, control system 214 may find an optimum emitter position for each target analyte and set the emitter position based on a combination (e.g., an average or a weighted average) of the optimum emitter positions for the target analytes.

In some examples, methods 500, 600, and 800 may be used to determine the quality of emitter 208 or to determine if emitter 208 is damaged. To this end, control system 214 may obtain data representative of a default home position of emitter 208 based on a given set of conditions (e.g., target analyte, solvent conditions, spray voltage, sheath gas flow rate, etc.) ("default optimization data"). The default optimization data may be generated prior to performing method 500, 600, or 800 for a particular experiment and may be stored in any location, such as in a remote computing system, in the emitter cartridge for emitter 208, or in mass spectrometer 100. The default optimization data may be generated for the particular emitter 208 in the factory (e.g., prior to shipping emitter 208 to a customer). Alternatively, the default optimization data may be generated remotely (e.g., remote from control system 214, mass spectrometer 100, or the emitter cartridge) based on optimization of one or more other emitters, such as based on an aggregation of optimization data collected for a plurality of different emitters each time a customer optimizes an emitter for an experiment.

Control system 214 may perform method 500, 600, or 800 to optimize the position of emitter 208 under the same or similar conditions as in the default optimization data. In some examples, prior to performing method 500, 600, or 800, control system 214 may initialize ion source 102 based on the default optimization data by positioning emitter 208 at the default home position and setting the other ion source settings to their default values. Control system 214 may then execute method 500, 600, or 800 to optimize the ion source settings.

Control system 214 may then compare the optimum ion source settings obtained with the default optimization data. If the optimum position of emitter 208 (or optimum spray voltage or sheath gas flow rate) is out of tolerance with the default optimization data (e.g., the optimum position varies from the expected optimum position by more than a threshold amount, or the measured signal at the optimum position does not satisfy a threshold criterion (e.g., a minimum threshold intensity or SNR level or maximum threshold RSD), control system 214 may determine that emitter 208 is damaged or installed incorrectly and may perform a mitigation operation. A mitigation operation may include alerting (e.g., by an audio, visual, or haptic notification or message) a user that emitter 208 is not functioning correctly (e.g., is damaged or installed improperly), adjusting hyperparameters, performing another optimization method under different conditions, prompting the user may make manual adjustments to emitter 208 or other ion source settings or optimization algorithm hyperparameters, and/or any other suitable operation.

In some examples the quality check process just described may be performed with respect to multiple different target analytes. For example, control system 214 may determine that emitter 208 is functioning properly only if the quality check is satisfied for a minimum number of target analytes or over a selected m/z range.

Various modifications may be made to the examples described above. For example, control system 214 may be configured to optimize multiple figures of merit, such as intensity and RSD, or intensity and SNR. Any suitable stochastic optimization algorithm may be used to optimize multiple figures of merit. In further examples, control system 214 may be configured to find an optimum emitter position based also on robustness of the system. For example, dirty samples may clog inlet 212, so a user may be willing to sacrifice some signal quality in order to keep inlet 212 cleaner. To this end, the objective function may be a cost function in which signal quality and system robustness are balanced, such as by increasing (or maximizing) the distance of emitter 208 from inlet 212 while maintaining a minimum threshold level of signal quality. In some examples, the cost function may specify a minimum threshold distance of emitter 208 from inlet 212, so that the optimum emitter position is at least the threshold distance from inlet 212. Additionally or alternatively, the cost function contains a set of possible solutions that are within a threshold range of the optimum of the figure of merit (e.g., maximum intensity) and the optimum emitter position is the position that is farthest from inlet 212 among all emitter positions within the set of possible solutions. That is, control system 214 optimizes the cost function by optimizing the desired figure of merit (e.g., intensity) and setting the emitter position at the farthest position from inlet 212 for which the figure of merit is within a threshold range (e.g., 10%) of the optimum of the figure of merit.

Furthermore, while the examples above describe optimizing a position of emitter 208 relative to inlet 212, control system 214 may additionally or alternatively optimize an angle of emitter 208 relative to inlet 212. In yet further modifications, the principles described herein may also be applied to any other type of ESI source, such as, but not limited to, conventional ESI, PaperSpray ionization, PolymerSpray ionization, and the like.

In certain embodiments, one or more of the processes described herein may be implemented at least in part as instructions embodied in a non-transitory computer-readable medium and executable by one or more computing devices. In general, a processor (e.g., a microprocessor) receives instructions, from a non-transitory computer-readable medium, (e.g., a memory, etc.), and executes those instructions, thereby performing one or more processes, including one or more of the processes described herein. Such instructions may be stored and/or transmitted using any of a variety of known computer-readable media.

A computer-readable medium (also referred to as a processor-readable medium) includes any non-transitory medium that participates in providing data (e.g., instructions) that may be read by a computer (e.g., by a processor of a computer). Such a medium may take many forms, including, but not limited to, non-volatile media, and/or volatile media. Non-volatile media may include, for example, optical or magnetic disks and other persistent memory. Volatile media may include, for example, dynamic random access memory ("DRAM"), which typically constitutes a main memory. Common forms of computer-readable media include, for example, a disk, hard disk, magnetic tape, any other magnetic medium, a compact disc read-only memory ("CD-ROM"), a digital video disc ("DVD"), any other optical medium, random access memory ("RAM"), programmable read-only memory ("PROM"), electrically erasable programmable read-only memory ("EPROM"), FLASH-EEPROM, any other memory chip or cartridge, or any other tangible medium from which a computer can read.

Figure 11:
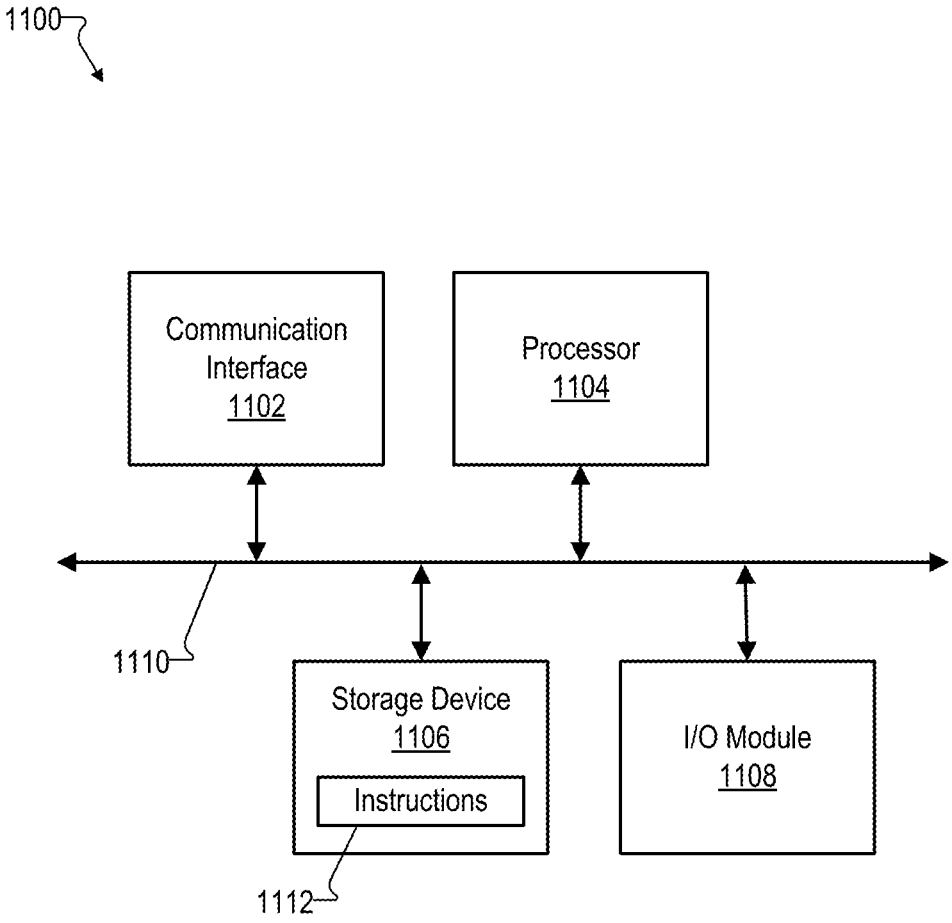
FIG. 11 shows an illustrative computing device.

FIG. 11 shows an illustrative computing device 1100 that may be specifically configured to perform one or more of the processes described herein. As shown in FIG. 11, computing device 1100 may include a communication interface 1102, a processor 1104, a storage device 1106, and an input/output ("I/O") module 1108 communicatively connected one to another via a communication infrastructure 1110. While an illustrative computing device 1100 is shown in FIG. 11, the components illustrated in FIG. 11 are not intended to be limiting. Additional or alternative components may be used in other embodiments. Components of computing device 1100 shown in FIG. 11 will now be described in additional detail.

Communication interface 1102 may be configured to communicate with one or more computing devices. Examples of communication interface 1102 include, without limitation, a wired network interface (such as a network interface card), a wireless network interface (such as a wireless network interface card), a modem, an audio/video connection, and any other suitable interface.

Processor 1104 generally represents any type or form of processing unit capable of processing data and/or interpreting, executing, and/or directing execution of one or more of the instructions, processes, and/or operations described herein. Processor 1104 may perform operations by executing computer-executable instructions 1112 (e.g., an application, software, code, and/or other executable data instance) stored in storage device 1106.

Storage device 1106 may include one or more data storage media, devices, or configurations and may employ any type, form, and combination of data storage media and/or device. For example, storage device 1106 may include, but is not limited to, any combination of the non-volatile media and/or volatile media described herein. Electronic data, including data described herein, may be temporarily and/or permanently stored in storage device 1106. For example, data representative of computer-executable instructions 1112 configured to direct processor 1104 to perform any of the operations described herein may be stored within storage device 1106. In some examples, data may be arranged in one or more databases residing within storage device 1106.

I/O module 1108 may include one or more I/O modules configured to receive user input and provide user output. One or more I/O modules may be used to receive input for a single virtual experience. I/O module 1108 may include any hardware, firmware, software, or combination thereof supportive of input and output capabilities. For example, I/O module 1108 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1108 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1108 is configured to provide graphical data to a display for presentation to a user. The graphical data may be representative of one or more graphical user interfaces and/or any other graphical content as may serve a particular implementation.

In some examples, any of the systems, computing devices, and/or other components described herein may be implemented by computing device 1100. For example, storage facility 302 may be implemented by storage device 1106, and processing facility 304 may be implemented by processor 1104.

It will be recognized by those of ordinary skill in the art that while, in the preceding description, various illustrative embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A system comprising:

one or more processors; and memory storing executable instructions that, when executed by the one or more processors, cause a computing device to:

receive mass spectra of ions emitted from an ionization emitter toward an inlet of a mass spectrometer; and control, based on the mass spectra, an automated motion system to adjust a position of the emitter relative to the inlet, wherein the controlling the automated motion system to adjust the position of the emitter relative to the inlet comprises performing an iterative optimization process configured to optimize a cost function that balances signal quality of the mass spectra and robustness of the mass spectrometer.

2. The system of claim 1, wherein the iterative optimization process is configured to optimize intensity, signal-to-noise ratio, or stability of mass spectra subsequently acquired by the mass spectrometer.

3. The system of claim 1, wherein the iterative optimization process is performed using a stochastic optimization algorithm.

4. The system of claim 1, wherein the iterative optimization process comprises a plurality of iterations each comprising:

controlling the automated motion system to sequentially position the emitter at a plurality of distinct locations near a current position of the emitter;

directing the mass spectrometer to acquire a mass spectrum while the emitter is positioned at each location included in the plurality of distinct locations;

determining, based on the mass spectra acquired while the emitter is positioned at each location included in the plurality locations, an updated position for the emitter; and controlling the automated motion system to move the emitter from the current position to the updated position.

5. The system of claim 4, wherein the instructions, when executed, further cause the computing device to:

determine that the mass spectra acquired during a current iteration are not better than the mass spectra acquired during a prior iteration; and terminate the iterative optimization process in response to the determining that the mass spectra acquired during the current iteration are not better than the mass spectra acquired during the prior iteration.

6. The system of claim 4, wherein the iterative optimization process further comprises:

determining that the mass spectra acquired during a current iteration fail to satisfy a criterion; and controlling, based on the determining that the mass spectra acquired during the current iteration fail to satisfy the criterion, the automated motion system to move the emitter from the current position toward a prior known good position.

7. The system of claim 6, wherein the moving the emitter from the current position toward the prior known good position is performed incrementally through a plurality of intermediate positions.

8. The system of claim 6, wherein the iterative optimization process further comprises:

adjusting, based on the determining that the mass spectra acquired during the current iteration fail to satisfy the criterion, at least one hyperparameter of the iterative optimization process.

9. The system of claim 8, wherein the at least one hyperparameter comprises at least one of a step size, a search area size, or a search scale.

10. The system of claim 1, wherein the automated motion system comprises one or more linear translation stages.

11. The system of claim 1, wherein the controlling the automated motion system to adjust the position of the emitter relative to the inlet is further based on one or more of a flow rate of a sheath gas flowing around the emitter, a flow rate of a mobile phase flowing to the emitter, a composition of a solvent in the mobile phase, or a spray voltage applied to the emitter.

12. The system of claim 1, wherein the instructions, when executed, further cause the computing device to:

adjust, based on the mass spectra, one or more of a flow rate of a sheath gas flowing around the emitter, a flow rate of a mobile phase flowing to the emitter, a composition of a solvent in the mobile phase, or a spray voltage applied to the emitter.

13. The system of claim 1, wherein:

the emitter is coupled with a separation system configured to separate, over time, components included in a sample; and the controlling the automated motion system to adjust the position of the emitter relative to the inlet is further based on a gradient of an effluent from the separation system.

14. The system of claim 13, wherein the controlling the automated motion system to adjust the position of the emitter relative to the inlet comprises scheduling adjustment of the emitter to a plurality of different positions at different times in the gradient.

15. The system of claim 1, wherein:

the controlling the automated motion system to adjust the position of the emitter relative to the inlet comprises determining an optimum position of the emitter relative to the inlet; and the instructions, when executed, further cause the computing device to:

obtain default home position data representative of a default home position of the emitter relative to the inlet;

determine that the optimum position of the emitter is out of tolerance with the default home position of the emitter; and perform, in response to the determination that the optimum position of the emitter is out of tolerance with the default home position of the emitter, a mitigation operation.

16. The system of claim 1, wherein the emitter comprises a nanospray ionization emitter.

17. A method comprising:

receiving, by a computing device from a mass spectrometer, mass spectra of ions emitted from an ionization emitter toward an inlet of the mass spectrometer; and controlling, by the computing device and based on the mass spectra, an automated motion system to adjust a position of the emitter relative to the inlet based on a gradient of an effluent from a separation system coupled with the emitter and configured to separate, over time, components included in a sample.

18. The method of claim 17, wherein the controlling the automated motion system to adjust the position of the emitter relative to the inlet comprises performing an iterative optimization process.

19. The method of claim 18, wherein the iterative optimization process is configured to optimize intensity, signal-to-noise ratio, or stability of mass spectra subsequently acquired by the mass spectrometer.

20. The method of claim 18, wherein the iterative optimization process is configured to optimize a cost function that balances signal quality of the mass spectra and robustness of the mass spectrometer.

21. The method of claim 18, wherein the iterative optimization process is performed using a stochastic optimization algorithm.

22. The method of claim 18, wherein the iterative optimization process comprises a plurality of iterations each comprising:

controlling the automated motion system to sequentially position the emitter at a plurality of distinct locations near a current position of the emitter;

directing the mass spectrometer to acquire a mass spectrum while the emitter is positioned at each location included in the plurality of distinct locations;

determining, based on the mass spectra acquired while the emitter is positioned at each location included in the plurality locations, an updated position for the emitter; and controlling the automated motion system to move the emitter from the current position to the updated position.

23. The method of claim 22, further comprising:

determining, by the computing device, that the mass spectra acquired during a current iteration are not better than the mass spectra acquired during a prior iteration; and terminating, by the computing device, the iterative optimization process in response to the determining that the mass spectra acquired during the current iteration are not better than the mass spectra acquired during the prior iteration.

24. The method of claim 22, further comprising:

determining, by the computing device, that the mass spectra acquired during a current iteration fail to satisfy a criterion; and controlling, by the computing device and based on the determining that the mass spectra acquired during the current iteration fail to satisfy the criterion, the automated motion system to move the emitter from the current position toward a prior known good position.

25. The method of claim 24, wherein the moving the emitter from the current position toward the prior known good position is performed incrementally through a plurality of intermediate positions.

26. The method of claim 24, further comprising:

adjusting, by the computing device and based on the determining that the mass spectra acquired during the current iteration fail to satisfy the criterion, at least one hyperparameter of the iterative optimization process.

27. The method of claim 26, wherein the at least one hyperparameter comprises at least one of a step size, a search area size, or a search scale.

28. The method of claim 17, wherein the automated motion system comprises one or more linear translation stages.

29. The method of claim 17, wherein the controlling the automated motion system to adjust the position of the emitter relative to the inlet is further based on one or more of a flow rate of a sheath gas flowing around the emitter, a flow rate of a mobile phase flowing to the emitter, a composition of a solvent in the mobile phase, or a spray voltage applied to the emitter.

30. The method of claim 17, further comprising:

adjusting, by the computing device and based on the mass spectra, one or more of a flow rate of a sheath gas flowing around the emitter, a flow rate of a mobile phase flowing to the emitter, a composition of a solvent in the mobile phase, or a spray voltage applied to the emitter.

31. The method of claim 26, wherein the controlling the automated motion system to adjust the position of the emitter relative to the inlet comprises scheduling adjustment of the emitter to a plurality of different positions at different times in the gradient.

32. The method of claim 17, wherein:

the controlling the automated motion system to adjust the position of the emitter relative to the inlet comprises determining an optimum position of the emitter relative to the inlet; and the method further comprises:

obtaining, by the computing device, default home position data representative of a default home position of the emitter relative to the inlet;

determining, by the computing device, that the optimum position of the emitter is out of tolerance with the default home position of the emitter; and performing, by the computing device and in response to the determination that the optimum position of the emitter is out of tolerance with the default home position of the emitter, a mitigation operation.

33. The method of claim 17, wherein the emitter comprises a nanospray ionization emitter.

* * * * *